US006287176B1

(12) United States Patent
Voigt

(10) Patent No.: US 6,287,176 B1
(45) Date of Patent: Sep. 11, 2001

(54) GRINDING DISK WITH PERIPHERAL GROOVE

(75) Inventor: Klaus Voigt, Remscheid (DE)

(73) Assignee: Wendt GmbH, Meerbusch (DE)

( * ) Notice: Subject to any disclaimer, the term of this patent is extended or adjusted under 35 U.S.C. 154(b) by 0 days.

(21) Appl. No.: 09/581,950

(22) PCT Filed: Jan. 15, 1999

(86) PCT No.: PCT/EP99/00195

§ 371 Date: Jun. 16, 2000

§ 102(e) Date: Jun. 16, 2000

(87) PCT Pub. No.: WO99/36225

PCT Pub. Date: Jul. 22, 1999

(30) Foreign Application Priority Data

Jan. 16, 1998 (DE) ..... 198 01 377

(51) Int. Cl.[7] ..... B24B 1/00

(52) U.S. Cl. ..... 451/44; 451/242; 451/246

(58) Field of Search ..... 451/41, 43, 44, 451/46, 66, 177, 178, 194, 242, 243, 246, 256, 258, 540, 541

(56) References Cited

U.S. PATENT DOCUMENTS 5,658,189 * 8/1997 Kagamida ..... 451/66

5,944,584 * 8/1999 Toyama ..... 451/43

FOREIGN PATENT DOCUMENTS

890401 * 4/1996 (JP) .

11320364 * 11/1999 (JP) .

* cited by examiner

*Primary Examiner*—Derris H. Banks

(74) *Attorney, Agent, or Firm*—Pandiscio & Pandiscio

(57) ABSTRACT

A grinding disk (20) has a a peripheral groove for grinding the edges of glass panes (11), whereby a cooling liquid is fed to the point of grinding (18). When the disk (20) is in a mounted position, a lateral stop surface (8) fits closely against the opposite surface (7) of the grinding spindle, whereby the axial position thereof in relation to the lane of the glass pane can be adjusted. In order to increase the service life of said tool, irrespective of the composition of the abrasive product, the grinding disk (20) has a stop surface (8(I), 8(II)) on two opposite-lying flat sides (I, II) in addition to two peripheral grooves (13,14), whereby each peripheral groove is assigned to one of the two stop surfaces (8(I), 8(II)). The two peripheral grooves (13,14) are located at the same distance (X,X) from the respective stop surfaces (8(I), 8(II)).

7 Claims, 1 Drawing Sheet

GRINDING DISK WITH PERIPHERAL GROOVE

Figure 1:
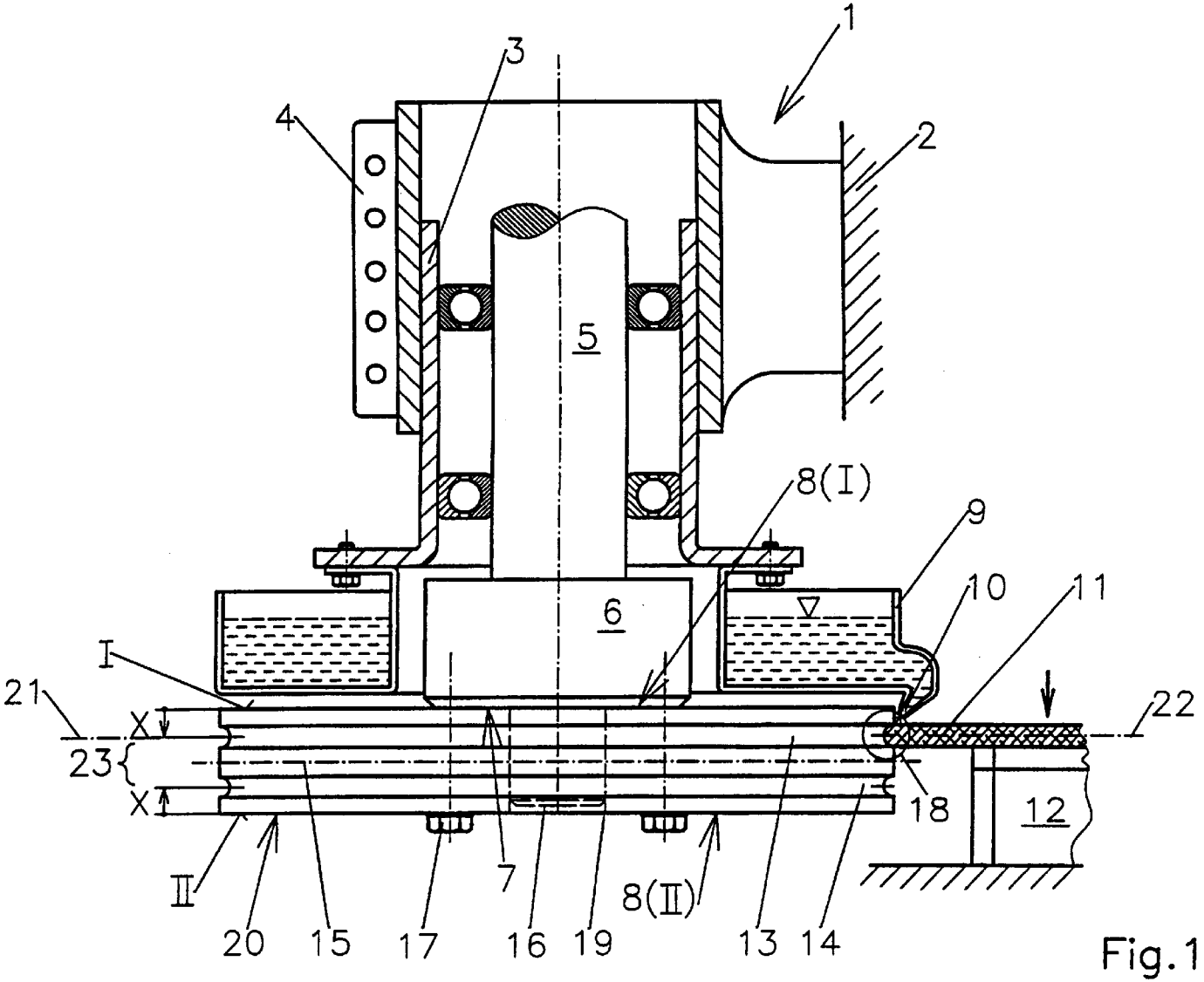

The invention relates to a grinding disk with a peripheral groove according to the preamble of Claim 1.

Grinding disks of this type are known. They are used to grind the edges of glass panes while simultaneously applying a cooling liquid to the point of grinding. The peripheral groove, which has a set contour that is dictated by the manufacturing process, is subject to wear over time. The grinding disk must then be replaced. In order to minimize this wear, a cooling fluid, usually water, is poured onto the point of grinding. The stream of water must be directed as precisely as possible onto a predetermined point while taking into consideration the relevant influence factors.

It is therefore important to pinpoint the exact position between the peripheral groove of the grinding disk, the edge of the glass pane that is to be ground and the point of impact of the stream of cooling liquid upon the area that is to be ground.

Since the stream of cooling liquid is usually stationary with respect to the grinding spindle, i.e. it can only be aligned in conjunction with the grinding spindle, the measurements of the series of grinding disks to be used must agree to the extent that the point of impact of the stream of cooling liquid with regard to the point of grinding is exactly retained.

It is therefore not possible to use just any desired series of grinding disks one after the other.

When such grinding disks are reconditioned, it is moreover necessary to take care that all grinding disks that are part of one series remain together and are not intermingled with grinding disks of a different series.

If we take into account that the peripheral groove of a grinding disk has a finite useful life before it must be reworked, a specific relationship between serviceable life and set-up time results.

The present invention is intended to improve this relationship. It is therefore the object of this invention to improve the grinding disk which is to be used for the specific application of grinding the edges of glass panes in such a way that the serviceable life of the tool is extended, regardless of what the abrasive is composed of.

The invention offers the advantage that the number of positioning procedures needed to align the geometry between the grinding disk, the glass pane and the stream of cooling liquid during each serviceable life cycle is cut in half.

Basically, this invention produces a doubling of the serviceable life of the tool in conjunction with a shorter reset time to allow for turning over the grinding disk when a worn peripheral groove is exchanged for a new peripheral groove.

In this context, it is important for the grinding disk to have one stop surface each on two opposing flat sides. This stop surface serves as a reference surface for determining the distance to one of two peripheral grooves. The other stop surface then forms the reference surface for the other peripheral groove. This makes it possible to use both sides of the grinding disk. Each of the stop surfaces is assigned a single peripheral groove. The geometrical distance between the stop surface and the peripheral groove is the same for both possibilities offered by the grinding disk.

This ensures that the critical distance between the stop surface and the peripheral groove always remains the same, irrespective of the how the grinding disk is mounted onto the grinding spindle.

The invention involves two embodiments.

In the first embodiment, each peripheral groove is assigned to the stop surface of the flat side that is directly adjacent to it. In the other embodiment, each peripheral groove is assigned to a stop surface situated on the opposite flat side.

It is the first embodiment, however, that is the more significant of the two since it is expected to be less prone to vibration.

In the following, the invention will be explained in greater detail based on one of the embodiments.

FIG. 1 shows one embodiment of the invention.

FIG. 1 shows a grinding spindle 1 firmly attached to and protruding from a machining frame 2. The grinding spindle 1 takes the form of a tube. A center sleeve 3, which can be fixed in place by means of a clamping cuff 4, extends inside the tube.

The drive axle 5 of the grinding machine, whose lower end has a graduation of diameters 6, is rotationally accommodated inside the center sleeve 3. At its lower end, the graduated diameters 6 form the counter surface 7 which the grinding disk 20 fits closely against. The grinding disk 20 is held against the counter surface 7 by means of the clamping screws 17 and with its stop surface 8 (I) is in direct contact with the counter surface 7.

The water container 9, supplied with cooling water from the outside (not shown), is firmly connected to the center sleeve 3.

The water container 9 has an outlet 10 which serves to supply cooling liquid to the point of grinding 18.

The glass pane 11 to be worked is placed on a stationary workpiece bracket 12, where it is clamped fast in an appropriate manner such that, as the grinding disk 20 turns, the edge of the glass pane 11 is continuously held inside the peripheral groove of the grinding disk 20, there to be reduced to the predetermined contour.

A variety of drive elements can be employed which will not be shown here.

This, however, involves a continual process in which the edge of the glass pane 11 is worked as though it were a continuous piece of goods, so to speak, while an uninterrupted flow of cooling liquid is being applied to the point of grinding 18.

In order to ensure that the peripheral groove of the grinding disk 20 is precisely aligned with the plane of the glass pane, the center sleeve 3 is vertically slideable inside the grinding spindle 1, and once the alignment position has been found, it is held fast by the clamping cuff 4.

It is of critical importance that the grinding disk 20 have one stop surface each 8(I), 8(II) at two opposing flat sides I,II, as well as two peripheral grooves 13,14, each of which is assigned to different one of the two stop surfaces 8(I), 8(II), and that both peripheral grooves 13,14 have the same distance X from their assigned stop surfaces 8(I), 8(II).

In addition, in the present case each peripheral groove 13,14 is assigned to the stop surface 8 of the flat side I,II that is immediately adjacent to it. This results in a grinding disk 20 that is symmetrical with respect to its central radial plane 15.

In order to ensure that the grinding disk 20 moves as concentrically precise as possible, the drive axle 5 has a centering pin 16 in the form of a rectilinear cylinder at its lower end that is situated inside a center hole 19 of the grinding disk 20 and takes the form of a corresponding rectilinear cylinder. A rectilinear cylindrical centering configuration of this type offers the advantage that it is retained even when the grinding disk 20 is turned over.

In addition, it is also possible to employ a centering configuration in which the grinding disk 20 has a conically applied center hole coming from each of its flat sides I or II, respectively, with each center hole working in conjunction with a centering pin, also conically shaped, which is situated on the drive axle 5.

The fundamental principle of the invention is based on the fact that one each of the two peripheral grooves is unambiguously assigned to one each of the two stop surfaces. This makes it possible to have just a single, permanently set axial position of the grinding spindle for each of the two peripheral grooves in one and the same grinding disk. Together with the axially adjustable grinding spindle, the invention therefore offers the advantage of viewing the grinding spindle as virtually static because of the doubled service life obtained for one and the same tool, inasmuch as each of the stop surfaces on the grinding disk determine identical spacings between the grinding spindle's counter surface 7 and one of the two peripheral grooves.

Thus, the invention represents a successful integration of the critical grinding surfaces which are symmetrical relative to the central radial plane of the grinding disk and help to ensure that the grinding process, begun with the previous peripheral groove, can continue within precise tolerances when switching from one of the two peripheral grooves to the other peripheral groove, in spite of the fact that the position of the machine remains unchanged.

Another essential feature is that the generally unavoidable manufacturing tolerances for determining the distance "X" have virtually the same values, thus making it unnecessary to readjust the grinding spindle axially when switching the grinding disk from one peripheral groove to the other, even when the manufacturing tolerances are taken into account.

A further essential point is that for each of the two possible stop surfaces 8,I;8,II only a single peripheral groove each has been provided which engages in a laterally arranged glass pane. During this engagement, the glass pane, in its fixed plane of motion, is guided tangentially to the peripheral groove of the grinding disk with its outer edge, thus reducing the edge of the glass pane to the geometrical profile of the peripheral groove.

When switching from one of the two peripheral grooves to the other peripheral groove, the existing degree of freedom of the grinding spindle, which allows for its axial longitudinal adjustment, is no longer needed thanks to the paired assignment between stop surface and peripheral groove.

Inasmuch as grinding disks of this type are customarily reprofiled from time to time, the advantages detailed above also become evident during the reprofiling process, since the spindle of the reprofiling machine no longer requires realignment.

Since grinding disks of this type customarily consist of a metallic supporting body with an abrasive coating on its outer circumference whose thickness is greater than the degree of wear which determines when a peripheral groove is no longer usable, such grinding disks can be subjected to repeated reprofilings, thus providing repeated cost savings.

It is also essential in this regard that the abrasive coating be equally effective in both possible rotational directions. This is achieved by applying the abrasive components of the coating such that they are independent of the rotational direction. The abrasive coating has no preferred grinding direction.

In addition, a space 23 is provided between the two peripheral grooves in such a way that the zones of the two peripheral grooves that are oriented toward the central area of the grinding disk do not touch each other. Moreover, the outer contour of the grinding disk outside of the two peripheral grooves is cylindrically rectilinear. On the one hand, this offers a simplified mode of manufacture, while on the other hand providing for an unproblematic draining away of the cooling liquid.

List of Reference Symbols

1 Grinding spindle
2 Machine frame
3 Center sleeve
4 Clamping cuff
5 Drive axle
6 Graduated diameter
7 Counter surface
8 Stop surface
9 Water container
10 Outlet
11 Glass pane
12 Workpiece bracket
13 First peripheral groove
14 Second peripheral groove
15 Central radial plane
16 Centering pin
17 Clamping screw
18 Point of grinding
19 Center hole
20 Grinding disk
21 Central radial plane of peripheral groove
22 Central plane of glass pane
23 Spacing
I First flat side
II Second flat side
X Spacing

What is claimed is:

1. A grinding disk assembly comprising a grinding disk having therein first and second peripheral grooves for grinding edges of glass panes, the grinding disk defining a center hole to accommodate a removable centering pin connectable to a drive axle for securing the disk to the drive axle, the drive axle being non reciprocally moveable during operation of the disk, the disk being provided with first and second parallel outer flat surfaces, a central radial plane of the first peripheral groove coinciding with a central plane of the glass pane, wherein the outer flat surfaces comprise two opposing flat sides, and the first and second grooves comprise two identically shaped peripheral grooves (13, 14), the first groove being adjacent the first flat surface and the second groove being adjacent the second flat surface, such that the central radial planes of the peripheral grooves (13, 14) are spaced the same distance from the respective adjacent flat sides, wherein by removing the centering pin from the disk and removing the disk from the drive axle, turning the disk over and reconnecting the disk to the drive axle with the centering pin, the second groove is positioned in place of the first groove to engage the glass pane edge.

2. The grinding disk assembly according to claim 1, wherein the grinding disk is symmetrical relative to a central radial plane thereof.

3. The grinding disk assembly according to claim 1, wherein no more than two of the peripheral grooves are provided.

4. The grinding disk assembly according to claim 3 wherein an outer contour of the grinding disk other than the two peripheral grooves extends in a cylindrically rectilinear fashion.

5. The grinding disk assembly according to claim 1, wherein an abrasive coating is disposed in the peripheral grooves.

6. A grinding disk (20) with a peripheral groove for grinding edges of glass panes (11) while a cooling liquid is applied to a point of grinding (18), wherein the grinding disk (20) has a continuous center hole (19) to accommodate a centering pin (16) of a grinding spindle (1) and in a mounted position fits closely against a counter surface (7) of the grinding spindle (1) with a lateral stop surface (8), wherein the axial position of the grinding spindle is adjustable in such a way relative to a plane of a glass pane that a central radial plane (21) of the peripheral groove coincides with a central plane (22) of the axially immovable glass pane, wherein starting from the center hole (19), the grinding disk (20) has a precisely defined stop surface (8(I), 8(II)) on each of two opposing flat sides (I, II), as well as two identically shaped peripheral grooves (13, 14), each of which is assigned to a different one of the two stop surfaces (8(I), (II)) in such a way that central radial planes of the two peripheral grooves (13, 14) have the same distance (x, x) from the specific stop surface (8(I), (II)) that is assigned to them, wherein each of the peripheral grooves (13, 14) of the stop surfaces (8(I), (II)) is assigned to the flat side (I, II) that is immediately adjacent to it, wherein the grinding disk (20) is symmetrical relative to its central radial plane (15), and wherein the grinding disk centerhole is a cylindrically rectilinear center hole for the cylindrically rectilinear centering pin (16) arranged on a drive axle (5).

7. A grinding disk (20) with a peripheral groove for grinding edges of glass panes (11) while a cooling liquid is applied to a point of grinding (18), wherein the grinding disk (20) has a continuous center hole (19) to accommodate a centering pin (16) of a grinding spindle (1) and in a mounted position fits closely against a counter surface (7) of the grinding spindle (1) with a lateral stop surface (8), wherein the axial position of the grinding spindle is adjustable in such a way relative to a plane of a glass pane that a central radial plane (21) of the peripheral groove coincides with a central plane (22) of the axially immovable glass pane, wherein starting from the center hole (19), the grinding disk (20) has a precisely defined stop surface (8(I), 8(II)) on each of two opposing flat sides (I, II), as well as two identically shaped peripheral grooves (13, 14), each of which is assigned to a different one of the two stop surfaces (8(I), (II)) in such a way that central radial planes of the two peripheral grooves (13, 14) have the same distance (x, x) from the specific stop surface (8(I) (II)) that is assigned to them, wherein each of the peripheral grooves (13, 14) of the stop surfaces (8(I), (II)) is assigned to the flat side (I, II) that is immediately adjacent to it, wherein the grinding disk (20) is symmetrical relative to its central radial plane (15), and wherein the grinding disk has a conical centering hole, brought in by one each of its flat sides (I, II), for a conical centering pin that is connected to a drive axle (5).

* * * * *